US005755053A

United States Patent [19]

Oakley

[11] Patent Number: 5,755,053

[45] Date of Patent: May 26, 1998

[54] SHOTGUN CONVERTER PLUG

[76] Inventor: Kevin Noel Oakley, Rte. 1, Box 134 K, Roxboro, N.C. 27573

[21] Appl. No.: 543,367

[22] Filed: Oct. 16, 1995

[51] Int. Cl.[6] ..... F41C 7/00

[52] U.S. Cl. ..... 42/51

[58] Field of Search ..... 42/51, 77; 102/444

[56] References Cited

U.S. PATENT DOCUMENTS

| | | | |
|---|---|---|---|
| 4,137,663 | 2/1979 | Farber | 42/51 |
| 4,222,191 | 9/1980 | Lee et al. | 42/77 |
| 4,227,330 | 10/1980 | Chapin | 42/77 |
| 4,232,468 | 11/1980 | Chapin | 42/77 |
| 4,437,249 | 3/1984 | Brown et al. | 42/51 |
| 4,519,157 | 5/1985 | Giangerelli | 42/83 |
| 5,010,677 | 4/1991 | Verney Carron | 42/77 |
| 5,307,583 | 5/1994 | Mahn et al. | 42/51 |
| 5,315,778 | 5/1994 | Wolford | 42/70.11 |
| 5,408,776 | 4/1995 | Mahn et al. | 42/51 |

*Primary Examiner*—Charles T. Jordan
*Assistant Examiner*—Meena Chelliah

[57] ABSTRACT

A plug for converting a shotgun into a muzzle-loaded gun. The inventive device includes a plug member positionable into a barrel of a shotgun. The plug member is shaped so as to define a primer cavity which can receive a primer cap. A communication cavity extends through the plug member for conveying a spark from the primer cap to black powder loaded into the shotgun barrel.

1 Claim, 2 Drawing Sheets

SHOTGUN CONVERTER PLUG

BACKGROUND OF THE INVENTION

1. Field of the Invention

The present invention relates to firearm structures and more particularly pertains to a shotgun converter plug for converting a shotgun into a muzzle-loaded gun.

2. Description of the Prior Art

The use of firearm structures is known in the prior art. More specifically, firearm structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art firearm structures include U.S. Pat. No. 5,010,677; U.S. Pat. No. 4,912,868; U.S. Pat. No. 4,437,249; U.S. Pat. No. 4,137,663; U.S. Pat. No. 5,307,583; and U.S. Pat. No. 4,519,157.

While these devices fulfill their respective, particular objectives and requirements, the aforementioned patents do not disclose a shotgun converter plug for converting a shotgun into a muzzle-loaded gun which includes a plug member positionable into a barrel of a shotgun, wherein the plug member is shaped so as to define a primer cavity for receiving a primer cap, and a communication cavity extending through the plug member for conveying a spark from the primer cap to black powder loaded into the shotgun barrel.

In these respects, the shotgun converter plug according to the present invention substantially departs from the conventional concepts and designs of the prior art, and in so doing provides an apparatus primarily developed for the purpose of converting a shotgun into a muzzle-loaded gun.

SUMMARY OF THE INVENTION

In view of the foregoing disadvantages inherent in the known types of firearm structures now present in the prior art, the present invention provides a new shotgun converter plug construction wherein the same can be utilized for converting a shotgun into a black powder rifle. As such, the general purpose of the present invention, which will be described subsequently in greater detail, is to provide a new shotgun converter plug apparatus and method which has many of the advantages of the firearm structures mentioned heretofore and many novel features that result in a shotgun converter plug which is not anticipated, rendered obvious, suggested, or even implied by any of the prior art firearm structures, either alone or in any combination thereof.

To attain this, the present invention generally comprises a plug for converting a shotgun into a muzzle-loaded gun. The inventive device includes a plug member positionable into a barrel of a shotgun. The plug member is shaped so as to define a primer cavity which can receive a primer cap. A communication cavity extends through the plug member for conveying a spark from the primer cap to black powder loaded into the shotgun barrel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shotgun converter plug apparatus and method which has many of the advantages of the firearm structures mentioned heretofore and many novel features that result in a shotgun converter plug which is not anticipated, rendered obvious, suggested, or even implied by any of the prior art tool guides, either alone or in any combination thereof.

It is another object of the present invention to provide a new shotgun converter plug which may be easily and efficiently manufactured and marketed.

It is a further object of the present invention to provide a new shotgun converter plug which is of a durable and reliable construction.

An even further object of the present invention is to provide a new shotgun converter plug which is susceptible of a low cost of manufacture with regard to both materials and labor, and which accordingly is then susceptible of low prices of sale to the consuming public, thereby making such shotgun converter plugs economically available to the buying public.

Still yet another object of the present invention is to provide a new shotgun converter plug which provides in the apparatuses and methods of the prior art some of the advantages thereof, while simultaneously overcoming some of the disadvantages normally associated therewith.

Still another object of the present invention is to provide a new shotgun converter plug for converting a shotgun into a muzzle-loaded gun.

Yet another object of the present invention is to provide a new shotgun converter plug which includes a plug member positionable into a barrel of a shotgun, wherein the plug member is shaped so as to define a primer cavity for receiving a primer cap, and a communication cavity extending through the plug member for conveying a spark from the primer cap to black powder loaded into the shotgun barrel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
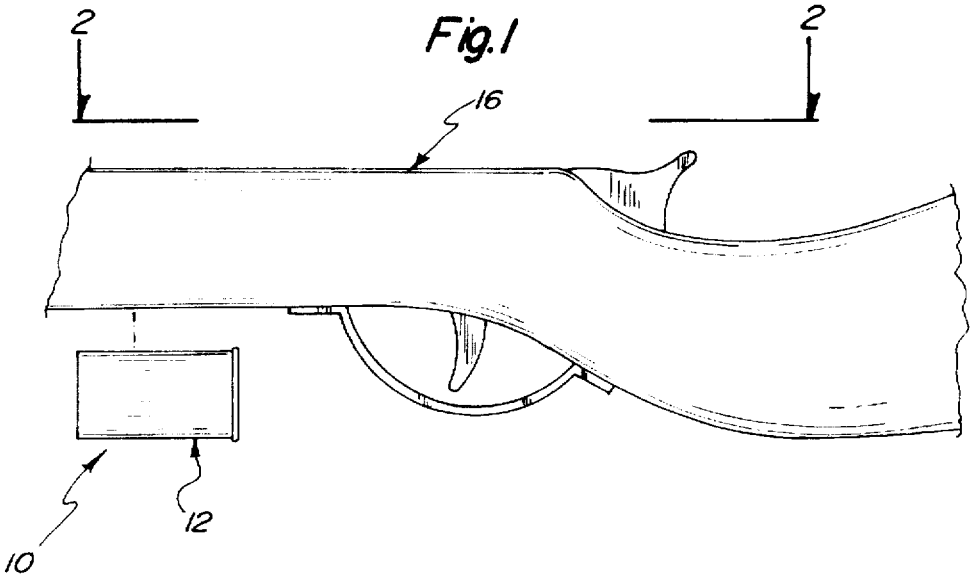
FIG. 1 is a elevation view of the present invention positioned for loading into a shotgun.

With reference now to the drawings, and in particular to FIGS. 1–4 thereof, a new shotgun converter plug embodying the principles and concepts of the present invention and generally designated by the reference numeral 10 will be described.

Figure 2:
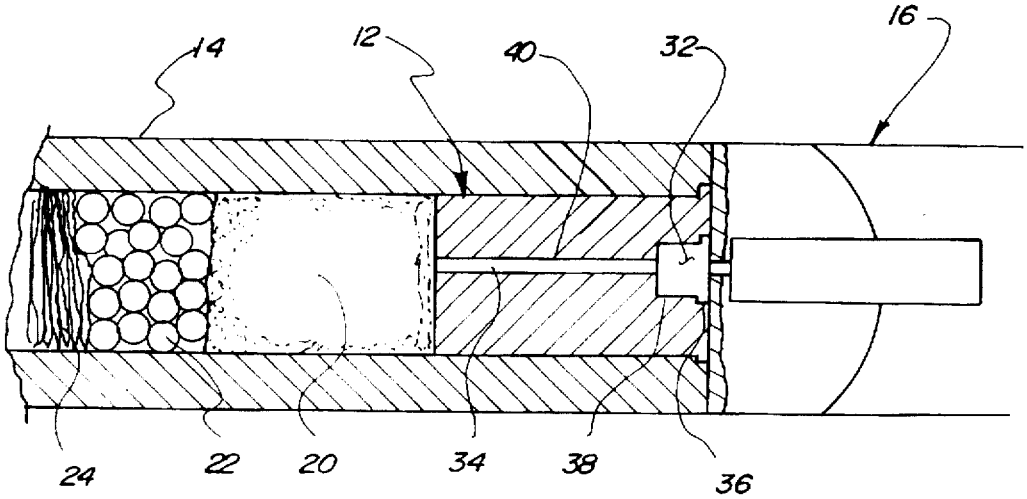
FIG. 2 is a top plan view, partially in cross section, of the present invention in use taken from line 2—2 of FIG. 1.
Figure 4:
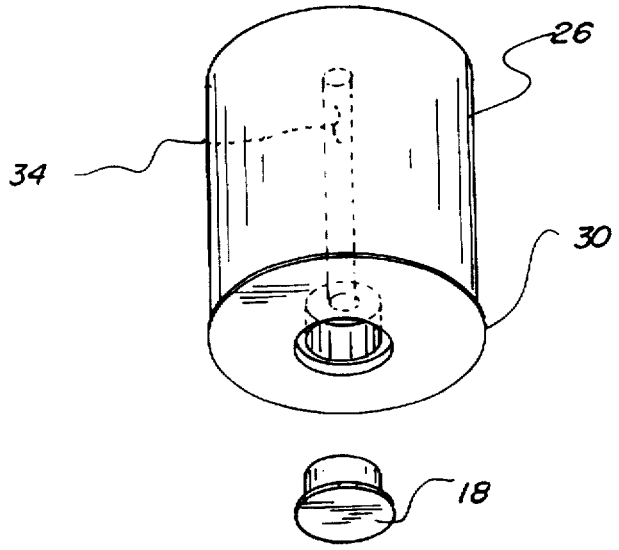
FIG. 4 is a bottom isometric illustration of the invention illustrating coupling of a primer cap thereto.

More specifically, it will be noted that the shotgun converter plug 10 comprises a plug member 12 adapted to be positioned within a barrel 14 of a shotgun 16, as shown in FIGS. 1 and 2 of the drawings. The plug member 12, as shown in FIG. 4, is configured to receive and support a primer cap 18 for ignition thereof by a hammer of the shotgun 16. By this structure, the plug member 12 can be positioned within a barrel 14 of a shotgun 16, with black powder 20, shot 22, and stuffing 24 being sequentially positioned within the barrel 14, whereby operation of the trigger of the shotgun 16 will cause the hammer thereof to engage the primer cap 18 to ignite the powder 20 and accelerate the shot 22 from the barrel 14 of the gun.

Figure 3:
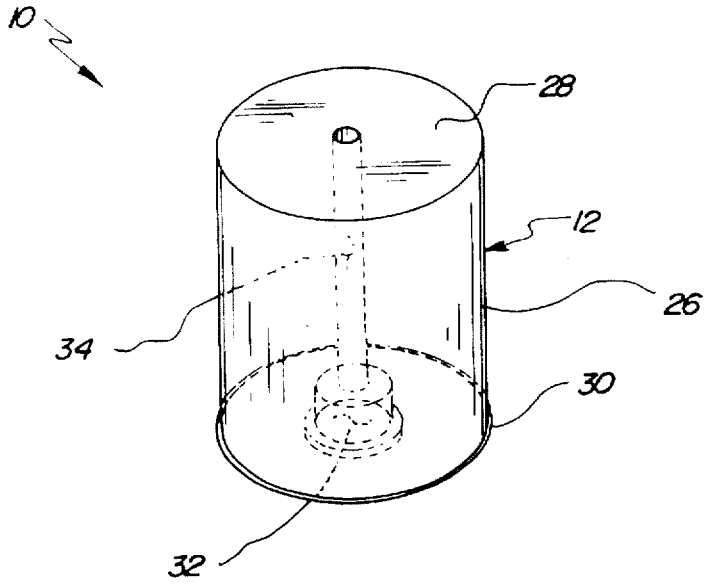
FIG. 3 is an isometric illustration of the present invention, per se.

Referring now to FIGS. 2 through 4 wherein the present invention 10 is illustrated in detail, it can be shown that the plug member 12 preferably comprises a solid cylindrical member 26 shaped so as to define a planar top surface 28 extending substantially orthogonally and transversely across the solid cylindrical member 26 at an upper end thereof. The solid cylindrical member 26 is further shaped so as to define an annular flange 30 extending substantially orthogonally and transversely across a lower end thereof. The annular flange 30 is characterized as having a first diameter, with the solid cylindrical member 26 being of a second diameter, wherein the first diameter is substantially greater than the second diameter so as to define the radially projecting annular flange 30 as shown in FIGS. 2 and 3 of the drawings. The solid cylindrical member 26 is further shaped so as to define a primer cavity 32 directed into the lower end thereof which operates to receive the primer cap 18 as illustrated in FIG. 4 of the drawings. A communication cavity 34 extends from contiguous communication with the primer cavity 32 completely through the solid cylindrical member 26 to exit through the planar top surface 28 thereof. The communication cavity 34 is centrally positioned within the solid cylindrical member 26 and permits a spark generated by the primer cavity 18 to be conveyed to the black powder 20 within the gun 16 when loaded as shown in FIG. 2 of the drawings.

Specifically, the primer cavity 32 as shown in FIG. 2 comprises a first cylindrical bore 36 directed a first distance into the lower end of the solid cylindrical member 26. A second cylindrical bore 38 is similarly directed a second distance into the lower end of the solid cylindrical member 26 and is concentrically positioned with respect to the first cylindrical bore 36. The first cylindrical bore 36 is of a third diameter, with the second cylindrical bore 38 being of a fourth diameter, wherein the third diameter is substantially greater than the fourth diameter as shown in FIG. 2 of the drawings. Further, the second distance of the second cylindrical bore 30 is substantially greater than the first distance of the first cylindrical bore 36 so as to accommodate the primer cap 18 as shown in FIG. 4 of the drawings.

The communication cavity 34 of the plug member 12 is defined by a third cylindrical bore 40 concentrically positioned with respect to the first and second cylindrical bores 36 and 38. The third cylindrical bore 40 extends a third distance from the lower end of the solid cylindrical member 26, wherein the third distance is substantially greater than the first and second distances of the respective first and second cylindrical bores 36 and 38. To ensure acceleration and projection of sparks and ignited gas from the third cylindrical bore 40 as generated by the primer cap 18, the third cylindrical bore 40 is preferably of a fifth diameter, wherein the fourth diameter is substantially greater than the fifth diameter so as to define the relatively narrow diameter of the third cylindrical bore 40 as shown in FIG. 2 of the drawings. Thus, a primer cap 18 ignited within the primer cavity 32 will accelerate sparks and heated gas through the third cylindrical bore 40. Because the third cylindrical bore 40 is of a diameter substantially less than the diameter of the second cylindrical bore 38 of the primer cavity 32, such sparks and heated gas will be further accelerated from the plug member 12 as a result of the Bernoulli effect caused by the disparate and reducing diameters of the second and third cylindrical bores 38 and 40.

In use, the shotgun converter plug 10 of the present invention can be easily utilized to convert a conventionally known shotgun 16 into a muzzle-loaded rifle wherein black powder 20, shot 22, and stuffing 24 are loaded into the open end of the barrel 14. The specific shape of the plug member 12 operates to ensure rapid projection of sparks and heated gas generated by the primer cap 18 into the powder 20 to ensure a complete and rapid ignition thereof.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the united states is as follows:

1. A shotgun converter plug comprising:

a plug member adapted to be positioned within a barrel of a shotgun, the plug member being configured to receive and support a primer cap for ignition thereof by a hammer of the shotgun such that the plug member can be positioned within a barrel of a shotgun, with black powder, shot, and stuffing being sequentially positioned within the barrel against the plug whereby operation of the trigger of the shotgun will cause the hammer thereof to engage a primer cap positioned within the plug to ignite the powder and accelerate the shot from the barrel of the gun;

wherein the plug member comprises a solid cylindrical member shaped so as to define a planar top surface extending substantially orthogonally and transversely across the solid cylindrical member at an upper end thereof, the black powder when positioned within the barrel being positioned against the planar top surface, the solid cylindrical member being further shaped so as to define an annular flange extending substantially orthogonally and transversely across a lower end thereof, the annular flange being characterized as having a first diameter, with the solid cylindrical member being of a second diameter, wherein the first diameter is substantially greater then the second diameter so as to define the radially projecting annular flange, the solid cylindrical member being further shaped so as to define a primer cavity directed into the lower end thereof which operates to receive a primer cap, and a communication cavity extending from in contiguous communication with the primer cavity completely through the solid cylindrical member to exit through the planar top surface thereof with a constant diameter;

wherein the communication cavity is centrally positioned within the solid cylindrical member along its entire length;

and wherein the primer cavity comprises a first cylindrical bore directed a first distance into the lower end of the solid cylindrical member, and a second cylindrical bore directed a second distance into the lower end of the solid cylindrical member and concentrically positioned with respect to the first cylindrical bore, the first cylindrical bore being of a third diameter, with the second cylindrical bore being of a fourth diameter, wherein the third diameter is substantially greater than the fourth diameter, with the second distance of the second cylindrical bore being substantially greater than the first distance of the first cylindrical bore;

and wherein the communication cavity of the plug member comprises a third cylindrical bore concentrically positioned with respect to the first and second cylindrical bores, the third cylindrical bore extending a third distance from the lower end of the solid cylindrical member, wherein the first distance is substantially treater than the first and second distances of the respective first and second cylindrical bores;

and wherein the third cylindrical bore is of a fifth diameter, wherein the fourth diameter is substantially greater than the fifth diameter so as to define a relatively narrow diameter of the third cylindrical bore with respect to the first and second cylindrical bores of the primer cavity such that sparks and heated gas generated by a primer cap positionable within the primer cavity will be accelerated from the plus member as a result of the Bernoulli effect created by the disparate and reducing diameters of the second and third cylindrical bores.

* * * * *